US006288642B1

(12) United States Patent
Dohrmann

(10) Patent No.: US 6,288,642 B1
(45) Date of Patent: Sep. 11, 2001

(54) SELF-CONTAINED SECURITY SYSTEM

(75) Inventor: Anthony Dohrmann, Owens Crossroad, AL (US)

(73) Assignee: Lasershield Systems, Inc., Carlsbad, CA (US)

( * ) Notice: Subject to any disclaimer, the term of this patent is extended or adjusted under 35 U.S.C. 154(b) by 0 days.

(21) Appl. No.: 09/432,669

(22) Filed: Nov. 2, 1999

(51) Int. Cl.[7] ..... G08B 21/00

(52) U.S. Cl. ..... 340/540; 340/541; 340/565; 340/691.1; 340/693.2

(58) Field of Search ..... 340/540, 541, 340/565, 567, 573.1, 691.1, 691.6, 693.2, 693.5, 525, 815.4, 636

(56) References Cited

U.S. PATENT DOCUMENTS 4,056,815 * 11/1977 Anderson ..... 340/224
4,064,507 * 12/1977 Schmitz ..... 340/384
4,498,075 * 2/1985 Gaudio ..... 340/525
4,943,799 * 7/1990 Papineau ..... 340/541
5,440,292 * 8/1995 Bedrosian ..... 340/567
5,463,595 * 10/1995 Rodhall et al. ..... 340/540
5,777,551 * 7/1998 Hess ..... 340/541
5,850,180 * 12/1998 Hess ..... 340/541
5,877,684 * 3/1999 Lu ..... 340/521
5,939,990 * 8/1999 Ahn ..... 340/636

* cited by examiner

*Primary Examiner*—Jeffery Hofsass
*Assistant Examiner*—Son Tang
(74) *Attorney, Agent, or Firm*—Jones, Waldo, Holbrook & McDonough; Michael W. Starkweather; Brent T. Winder

(57) ABSTRACT

A security system comprising at least one satellite unit coupled in signal communication to a main unit, the main unit for emitting an alerting stimulus in response to a signal received from the satellite unit indicating the presence of a security threat.

14 Claims, 4 Drawing Sheets

SELF-CONTAINED SECURITY SYSTEM

FIELD OF THE INVENTION

This invention relates to security systems and, more particularly, to portable, self-contained security systems.

BACKGROUND OF THE INVENTION

Security systems normally warn of danger by means of audible and/or visual stimulus. Given the dangers or threats against safety or security posed by fire, gas leaks, unsafe carbon monoxide levels and other catastrophic events and unwanted intruders such as thieves, burglars and vandals, the art is replete with dedicated alarm or security systems for use in homes and businesses. These security systems are normally difficult to install and considerably expensive. To meet consumer needs, skilled artisans have devoted considerable effort toward portable self-contained security systems, which give consumers a less expensive and convenient alternative to the more expensive dedicated security systems. However, known self-contained security systems are difficult to construct, and suffer from structural and organizational shortcomings that impede efficient operation and installation throughout a structure having many separate rooms. In view of these and other deficiencies in the art, the need for certain new and useful improvements is evident.

Accordingly, it would be highly desirable to provide a new and improved self-contained security system.

It is a purpose of the invention to provide a new and improved self-contained security system that is easy to construct.

It is another purpose of the invention to provide a new and improved self-contained security system that is inexpensive.

It is still another purpose of the invention to provide a new and improved self-contained security system that is easy to install.

It is a further provision of the invention to provide a new and improved self-contained security system for use in apartments, homes, small business, boats, trailers, motor homes and other structures lacking a dedicated security system.

It is still a further provision of the invention to provide a new and improved self-contained security system suitable for use by the blind and the hearing impaired.

It is yet still a further purpose of the invention to provide a new and improved self-contained security system having a network of detectors each for detecting one or more security threats.

It is yet a further purpose of the invention to decrease the cost of homeowner and business insurance for those homes or business lacking dedicated security systems.

It is another provision of the invention to provide less fortunate individuals with an inexpensive means of protecting their families against dangers posed by security threats.

It is yet another provision of the invention to provide a new and improved self-contained security system that is difficult for an intruder to deactivate or destroy.

SUMMARY OF THE INVENTION

The above problems and others are at least partially solved and the above purposes and others realized in a new and improved security system comprising a main unit including a housing containing programmable apparatus movable between an active or "ARMED" state for emitting an alerting stimulus in response to the presence of a security threat, an inactive or "DISARMED" state and a "TROUBLED STATE" indicating irregular operation. An indicator indicates whether the apparatus is in the "ARMED," "DISARMED" and "TROUBLED" states. The housing preferably defines the shape of a pyramid, and the alerting stimulus comprises one or more of a visual stimulus provided from a lamp and/or a segmented display, an audible stimulus provided from a horn or speaker, and the activation of a signal apparatus for alerting emergency personnel over a communication pathway. The apparatus includes a detector for detecting the security threat whether posed from an intruder, fire, gas or carbon monoxide buildup, or other form of security threat. The system may further include one or more satellite units coupled in signal communication with the main unit. Each satellite unit include similar structure to that of the main unit, and in response to sensing a security threat, sends a signal to the main unit which causes the main unit to emit one or more of the alerting stimuli.

BRIEF DESCRIPTION OF THE DRAWINGS

The foregoing and further and more specific objects and advantages of the invention will become readily apparent to those skilled in the art from the following detailed description taken in conjunction with the drawings in which.

DETAILED DESCRIPTION OF A PREFERRED EMBODIMENT

Figure 2:
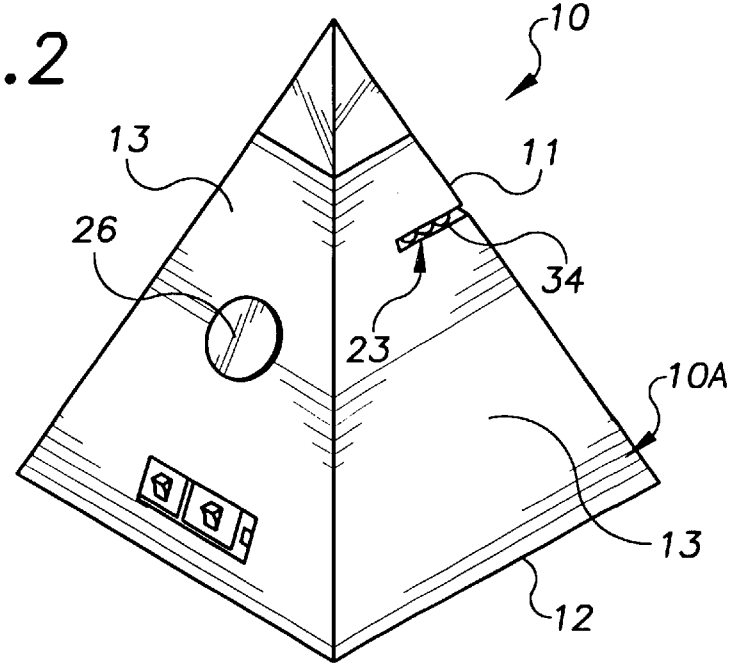
FIG. 2 is another perspective view of the security system of FIG. 1.
Figure 1:
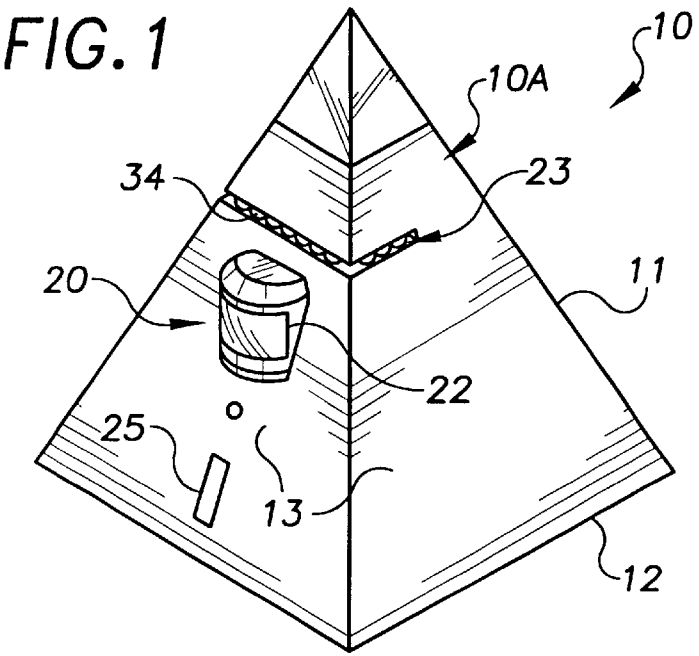
FIG. 1 is a perspective view of a security system.

Turning to the drawings, in which like reference characters indicate corresponding elements throughout the several views, FIGS. 1 and 2 illustrate perspective views of a security system 10 for detecting a security threat and for emitting an alerting stimulus in response to the presence of the security threat. System 10 is self-contained, portable and ideally suited for use in structures such as houses, apartments, businesses, boats, trailers, motor- and mobile-homes and other structures lacking dedicated security systems. The security threat may comprise an intruder, fire, gas or carbon monoxide buildup, or other form of security threat. System 10 is comprised of a main unit 10A including a housing 11 that contains apparatus 20 (FIG. 1) for detecting a security threat and for emitting an alerting stimulus in response to the presence of the security threat. Housing 11 defines a pyramid shape having a polygonal base 12 and triangular faces 13 that meet at a common point 14, and is preferably constructed of strong plastic and/or a selected metal or metallic composite material or one or more other strong, rigid materials. The pyramid shape is very important, as it makes housing 11 very strong and virtually unbreakable by intruders. Unit 10A normally rests with base 12 against surface and common point 14 projecting upwardly.

Should an intruder attempt to destroy unit 10A, his or her first approach would likely be to stomp or hit housing 11 with an impacting force such as with his or her feet or hands. With common point 14 being very pointy, this will normally result in considerable pain to the intruder. Without a relatively easy way to provide a damaging impacting force to unit 10A, it is envisioned that the intruder will become frustrated and leave the premises.

Figure 6:
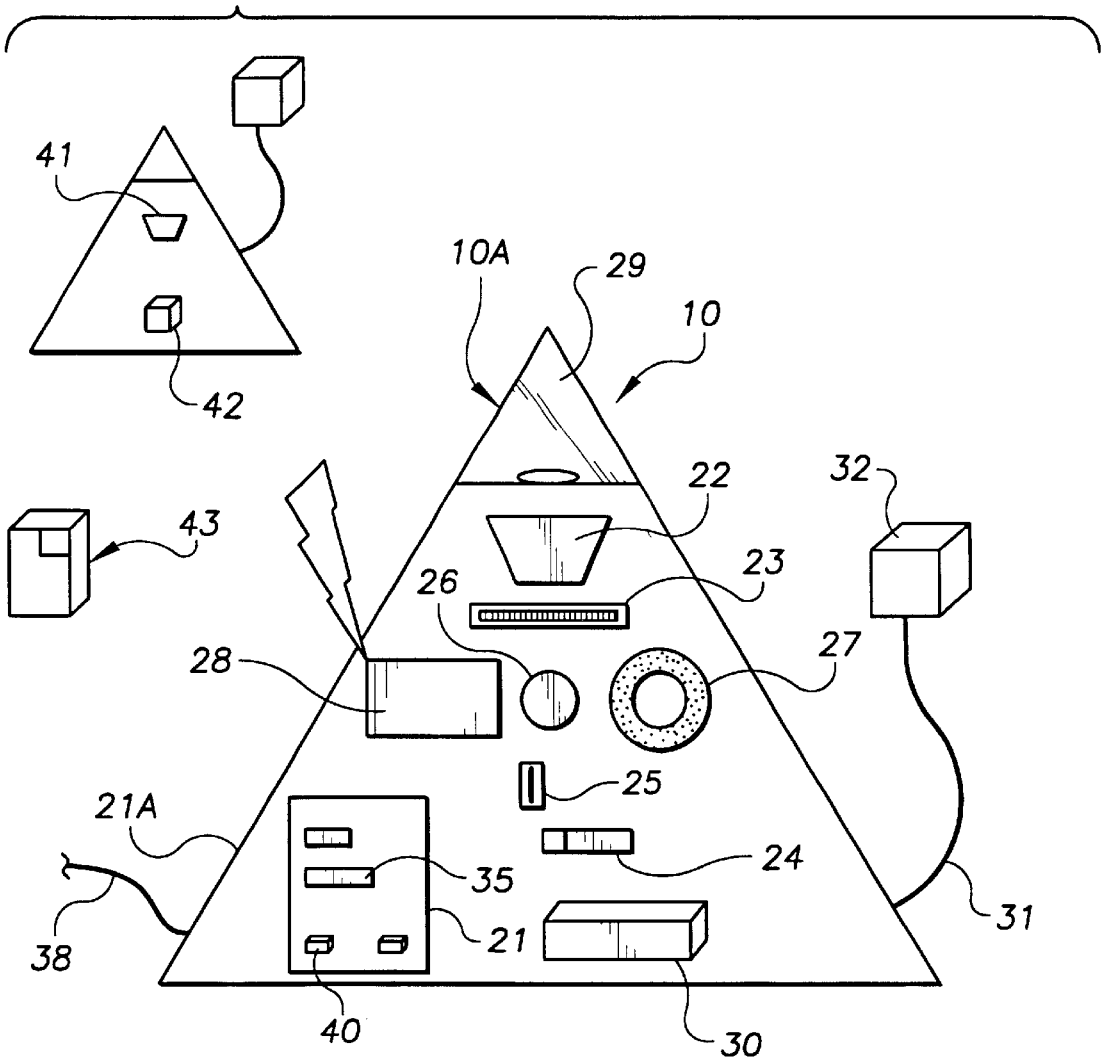
FIG. 6 is a schematic view of the security system of FIG. 1 and a satellite element.

Turning to FIG. 6, shown is a schematic representation of system 10 including apparatus 20. Apparatus 20 gas shown in FIG. 6, is comprised of a variety of components including controller 21, a detector 22, a segmented display 23, a switch 24, a display 25, an emergency/panic switch 26, a speaker or horn 27, a receiver 28, a lamp 29, a discrete power source 30 and a power cord 31 engagable to a fixed power source 32 such as a wall transformer. Lamp 29 is located at and defines the common point 14 of housing 11, although it may be located at other locations. Controller 21 is programmable and contains a micro-controller or processing apparatus 21A and software for controlling the operation of the processing apparatus 21A. Processing apparatus 21A controls the operation of apparatus 20 and the interaction between the various components of apparatus 20. Electrical power may be provided to controller 21 from the fixed power source 32 via power cord 31, and from discrete power source 30. Discrete power source 30 preferably comprises a rechargeable nickel-cadmium battery or other form of discrete, rechargeable power source. Controller 21 is coupled electrically to discrete power source 30, power cord 31 and to components 22–29 in a conventional manner. Power cord 31 is also coupled electrically to discrete power source 30, and provides discrete power source 30 with charging electrical energy when plugged into fixed power source 32. Electrical power is channeled to components 22–29 through controller 21.

Figure 5:
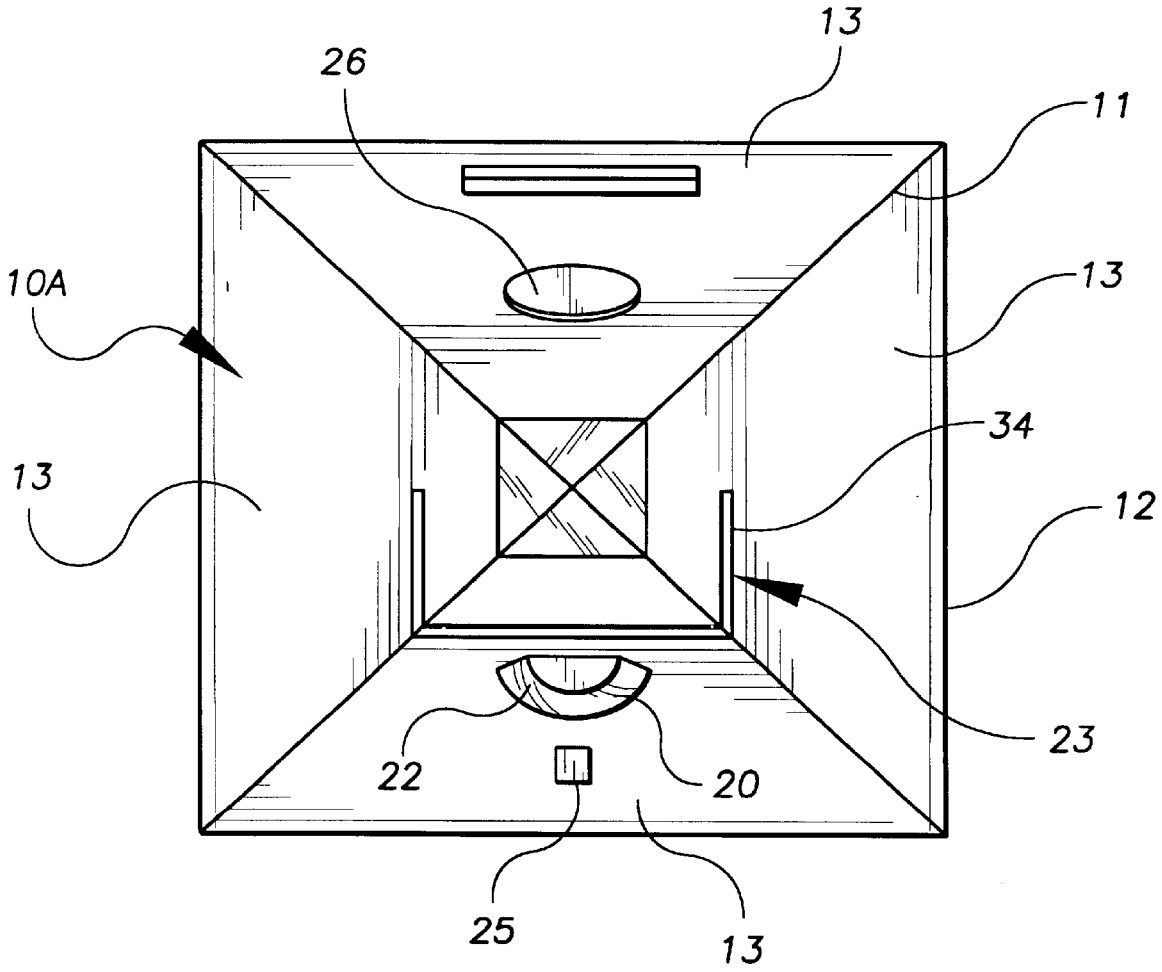
FIG. 5 is a top plan view of the security system of FIG. 1.

Turning back to FIG. 1, detector 22 is carried by housing 11 and is exposed through one of faces 13, which allows it to sense a security threat such as in the form of motion from an intruder, heat from fire, noise from broken glass or the like, and/or gas or carbon monoxide. In this regard, detector 22 may comprise an infrared motion detector, a heat detector, a noise detector and/or a gas and/or carbon monoxide detector. Regarding FIG. 3, segmented display 23 is comprised of a plurality of lights 33 arranged in substantially linear series. Lights 33 are carried by housing and are exposed through, in this specific example, three faces 13 of housing 11. Lights 33 are exposed through a groove 34 defined, as best shown in FIG. 5, by three of the faces 13 of housing 11. In alternate embodiments, lights 33 may be exposed through only one face 13 or all four faces 13.

Figure 4:
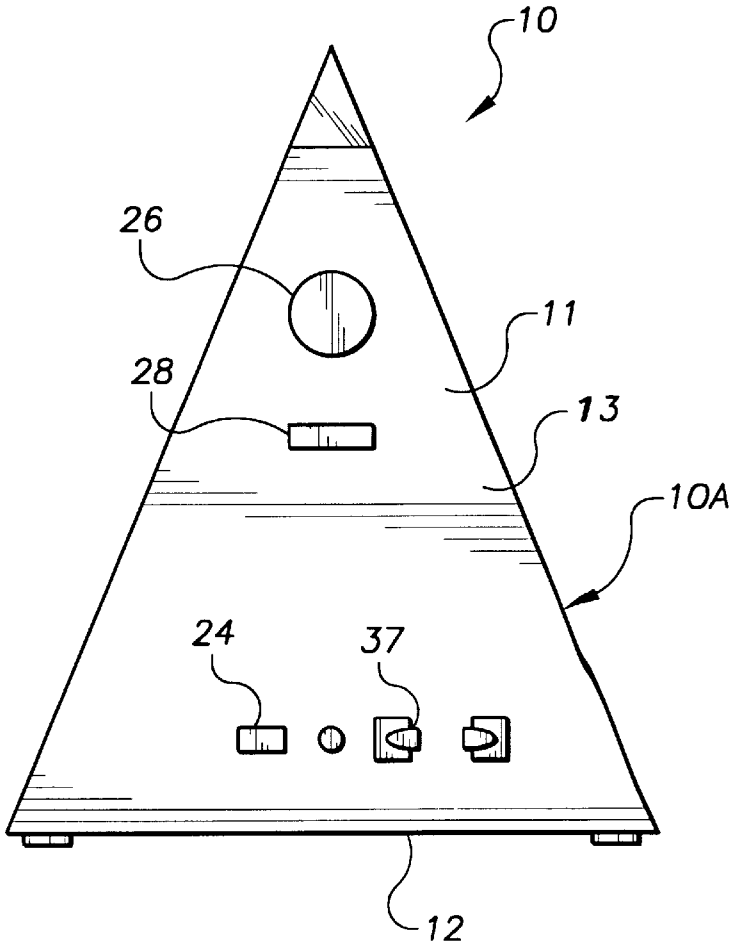
FIG. 4 is a rear elevational view of the security system of FIG. 1.
Figure 3:
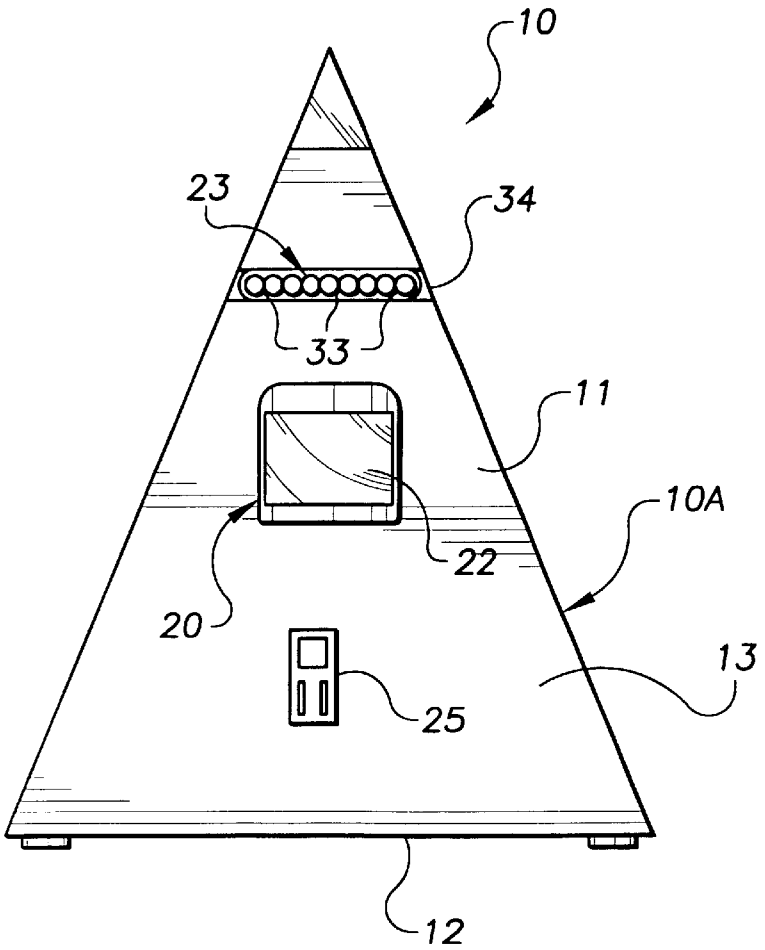
FIG. 3 is a front elevational view of the security system of FIG. 1.

Display 25 and switch 24 are each exposed and supported by housing 11 (FIGS. 3 and 4, respectively). Switch 24 is conveniently located and may be engaged and moved by a user between an "ON" position for placing apparatus 20 into an active or "ARMED" condition and an "OFF" position for placing apparatus 20 into an inactive or "DISARMED" condition. In the "ARMED" condition, apparatus 20 is active for sensing a security threat and for emitting an alerting stimulus in response to sensing a security threat. In the "DISARMED" condition, apparatus 20 is, of course, inactive. Display 25 is preferably an illuminated display such as an LED or other suitable illuminated display, and tells whether apparatus 20 is in the "ARMED" condition by displaying an "A," and the "DISARMED" condition by displaying a "D." As long as discrete power source 30 can provide power, controller 21 is always energized and actuates display 25 for showing the "A" or the "D" regardless of whether power cord 31 is plugged into a fixed power source.

System 10 evokes a relatively small, compact countenance, and may be situated anywhere in a room a user desires. After plugging power cord 31 into a fixed power source, such as fixed power source 32, the user may move switch 24 for placing apparatus 20 into the "ARMED" condition. Normally, system 10 is activated when the owner or occupant is leaving the given premises or, perhaps, going to bed. Upon arming apparatus 20, horn 27 will chirp a given number of times, such as seven or other desired number, segmented display 23 will flash and display 25 will show the "D." This defines an "Exit Delay" mode of apparatus 20, during which time a user is given time to leave the premises prior to system 10 arming itself. After a predetermined period of time has elapsed, such as ten to fifteen seconds, apparatus 20 will move out of the "Exit Delay" mode and into the "ARMED" condition, at which time horn 27 chirps a given number of times, such as two, display 25 displays the "A" and segmented display 23 ceases its flashing.

In the "ARMED" condition, apparatus 20 is sensitive to one or more security threats and emits an alerting stimulus in response to detecting a security threat. Controller 21 initiates the alerting stimulus in response to detector 22 detecting one or more of the security threats. The alerting stimulus may comprise an illumination of lamp 29, an activation of horn 27 to emit a loud audible stimulus or alarm, an illumination of segmented display 23 and/or an activation of a signal apparatus 35 for alerting emergency personnel over a communication pathway. Controller 21 may be programmed for emitting any one or more or each of the alerting stimuli. Signal apparatus 35 is considered an optional part of apparatus 20, and comprises a programmable telecommunication device 35A that upon activation, places a call to a central monitoring station. By virtue of the central monitoring station receiving the call, monitoring personnel stationed at the central monitoring station become alerted to a potential emergency situation and the location from which the call is being placed. In response to being alerted to the emergency situation, the monitoring personnel can then either dispatch fire, police and/or paramedic emergency personnel or alert the fire, police and/or paramedic emergency personnel to the emergency situation. Device 35A may be provided to facilitate telecommunication over a wireless telecommunication pathway or a hard telecommunication pathway. In regards to the latter, FIG. 4 illustrates a conventional phone jack 37 supported by housing 11 for providing engagement to a conventional phone line 38 shown only in FIG. 6. In the event a user feels threatened from a security threat, the user may simply engage and actuate panic switch 26, which will automatically cause apparatus 20 to emit the programmed alerting stimulus.

Panic switch 26 may be actuated regardless of whether apparatus 20 is in the "ARMED" or "DISARMED" conditions.

To further indicate the "ARMED" and "DISARMED" conditions to people having difficulty hearing or seeing, controller 21 may be programmed to activate segmented display into one of a plurality of different illuminated conditions, each illuminated condition for indicating one of the "ARMED" and "DISARMED" conditions. The illuminated conditions may comprise a strobing condition, a rolling condition, a steady condition, etc. In addition to the "ARMED" and "DISARMED" conditions, apparatus 20 may also be moved into a "TROUBLED" condition. During normal use, system 10 should always be coupled to a fixed power source. In the event power cord 31 becomes disengaged from fixed power source 32, the wireless or hard telecommunication pathway of signal apparatus 35 becomes severed, and/or in the event the power remaining in discrete power source falls below a predetermined threshold, which threshold may be programmed into controller 21, controller 21 may be programmed to actuate horn 27 for emitting a loud audible siren or stimulus and/or segmented display 23 to indicate one or both of these events, each of which comprise a "TROUBLED CONDITION." The "TROUBLED CONDITION" may be solved by plugging power cord 31 into a fixed power source, replacing discrete power source 30 or recharging discrete power source 30 above the predetermined threshold. Once the troubled condition is remedied, controller 21 deactivates horn 27 and/or segmented display 23.

In addition to placing apparatus 20 into the "ARMED" and "DISARMED" conditions, switch 24 may also be actuated for turning lamp 29 "ON" and "OFF." When turned "ON," lamp 29 illuminates. In this illuminated state, unit 10A may be held and used as a flashlight. Additionally, in the event power cord 31 becomes disengaged from fixed power source 32, either accidentally or by an intruder, discrete power source 30 will continue to provide power to apparatus 20. However, in response to the disengagement of power cord 31 from the fixed power source 32 such that the only power provided comes from discrete power source 30, controller 21 may be programmed to actuate and illuminate lamp 29. Power fail circuitry 40 of controller 21 provides this function. Accordingly, system 10 can be immediately and easily unplugged to be used as an emergency flashlight to illuminate safe exits. Upon re-engaging power cord 31 to fixed power source 32, controller 21 is normally programmed to deactivate lamp 29. Lamp 29 is contained in a transparent housing which defines that portion of housing 11 leading to common point 14, and is preferably comprised of a halogen light bulb or other high intensity fixture suitable for providing a bright illumination.

Regarding FIG. 6, receiver 28 is comprised of broadband or radio frequency signal receiver. To enhance functionality, system 10 may incorporate at least one satellite unit 41 that may be placed at a location remote from unit 10A. Satellite unit 41 includes the same structural components as unit 10A, details of which will not be again discussed. However, instead of a receiver, satellite unit 41 includes a transmitter 42. In a preferred embodiment, transmitter 42 comprises a broadband or radio frequency transmitter. Transmitter 42 is coupled in signal communication with receiver 28. In the event satellite unit 41 detects a security threat, its controller sends a signal from transmitter 42 to receiver 28 of unit 10A. In response to receiving this signal, controller 21 initiates the alerting stimulus. Any number of satellite units may be used. Furthermore, rather than couple one or more satellite units to unit 10A over a wireless pathway, they may be hard wired together if desired.

The invention has been described above with reference to one or more preferred embodiments. However, those skilled in the art will recognize that changes and modifications may be made in the described embodiments without departing from the nature and scope of the invention. The various components of system 10 may be configured and controlled by operation of a remote device or control. Also, system 10 could further include a telephone component comprising a conventional wireless telephone, whether ground- or earth satellite-based. The alerting stimulus of system 10 may further comprise an activation of signal apparatus 35 to place a call to the telephone component for emitting an audible stimulus at the telephone component for indicating an emergency. The user may terminate the call and then immediately place a call to emergency personnel. The telephone component is preferably provided with programming such that in response to actuation of a single button, will place a call to emergency personnel, such as a 911 call.

Various changes and modifications to one or more of the embodiments herein chosen for purposes of illustration will readily occur to those skilled in the art. To the extent that such modifications and variations do not depart from the spirit of the invention, they are intended to be included within the scope thereof, which is assessed only by a fair interpretation of the following claims.

Having fully described the invention in such clear and concise terms as to enable those skilled in the art to understand and practice the same, the invention claimed is:

1. A security system comprising:

at least one satellite unit coupled in signal communication to a main unit, the main unit further comprising a housing, the housing being substantially in the form of a pyramid with a base and at least three faces converging at an apex, and an apparatus for emitting an alerting stimulus in response to a signal received from the satellite unit indicating the presence of a security threat;

at least one controller contained by the at least one satellite unit and the main unit;

a lamp positioned on the at least one satellite unit and the main unit, such that there is no portion of the security system above the lamp obstructing the lamp's illumination;

a discrete power source contained by the at least one satellite unit and the main unit for providing power to the controller and the lamp;

a power cord engagable to a fixed power source for providing power to the controller and the lamp, the lamp movable by the controller into an illuminated condition in response to the controller receiving power only from the discrete power sources;

a panic switch located on one of the at least three faces, for causing the apparatus to emit the alerting stimulus upon actuation of the panic switch;

a detector, for detecting the presence of at least one security threat, located on one of the at least three faces, oriented in an approximately vertical position, forming an angle with the one of the at least three faces upon which the detector is placed, the detector and the panic switch being located on different faces; and a segmented light fixture including a plurality of lights arranged in substantially linear series, the plurality of lights being parallel to a horizontal edge of the housing base, the plurality of lights being placed in different illuminated states by the controller in response to detecting one of the ARMED, DISARMED and TROUBLED conditions.

2. The security system of claim 1, wherein the alerting stimulus comprises one or more of an audible stimulus and a visual stimulus.

3. The security system of claim 1, further including signal apparatus, the alerting stimulus comprising an activation of the signal apparatus for alerting emergency personnel over a communication pathway.

4. The security system of claim 1, wherein the discrete power source comprises a rechargeable battery.

5. The security system of claim 1, wherein the lamp carried by the at least one satellite unit and the main unit main unit is movable into an illuminated condition in response to actuation of a switch.

6. A security system comprising:

a housing, substantially in the form of a pyramid and having a base and at least three faces converging at an apex, the housing containing an apparatus for emitting an alerting stimulus in response to the presence of a security threat;

a controller contained by the housing for controlling operation of the security system;

a lamp positioned at the apex of the housing, such that there is no portion of the security system above the lamp obstructing the lamp's illumination;

a discrete power source contained by the housing for providing power to the controller and the lamp;

a power cord engagable to a fixed power source for providing power to the controller and the lamp, the lamp movable by the controller into an illuminated condition in response to the controller receiving power only from the discrete power source;

a detector, for detecting a security threat, on one of the at least three faces, oriented in an approximately vertical position, forming an angle with the one of the at least three faces upon which the detector is placed; and a panic switch on one of the at least three faces, for causing the apparatus to emit the alerting stimulus upon actuation of the panic switch, the panic switch being on a different face than the detector.

7. The security system of claim 6, wherein the alerting stimulus comprises at least one of a visual stimulus and an audible stimulus.

8. The security system of claim 6, wherein the apparatus is movable between an ARMED condition, a DISARMED condition, and a TROUBLED condition.

9. The security system of claim 8, further comprising a segmented light fixture, including a plurality of lights arranged in substantially linear series, the plurality of lights being parallel to a horizontal edge of the housing base, the plurality of lights being placed in different illuminated states by the controller in response to detecting one of the ARMED, DISARMED and TROUBLED conditions.

10. The security system of claim 9, wherein the illuminated states are selected from the group consisting of: a strobing illuminated state, a rolling illuminated state, and a steady illuminated state.

11. The security system of claim 6, wherein the detector comprises a motion detector.

12. The security system of claim 6, wherein the housing contains a signal apparatus, for alerting emergency personnel over a communication pathway in response to an alerting stimulus.

13. The security system of claim 6, wherein the discrete power source comprises a rechargeable battery.

14. The security system of claim 6, wherein the lamp is movable into an illuminated condition in response to actuation of a switch.

* * * * *